US005826426A

United States Patent [19]

Weber et al.

[11] Patent Number: 5,826,426

[45] Date of Patent: Oct. 27, 1998

[54] OXYGEN SENSOR LINEARIZATION SYSTEM AND METHOD

[75] Inventors: Gregory T. Weber, Commerce; Christopher P. Thomas, Bloomfield; Michael T. Vincent, Novi; Michael W. Weglarz, Macomb; Gary L. Seitz, Chelsea, all of Mich.

[73] Assignee: Chrysler Corporation, Auburn Hills, Mich.

[21] Appl. No.: 902,731

[22] Filed: Jul. 30, 1997

[51] Int. Cl.[6] ..... F01N 3/00

[52] U.S. Cl. ..... 60/274; 60/276

[58] Field of Search ..... 123/689, 676; 60/274, 276

[56] References Cited

U.S. PATENT DOCUMENTS 5,056,308 10/1991 Kume et al. ..... 60/276
5,544,640 8/1996 Thomas et al. .
5,596,975 1/1997 Thomas et al. .
5,706,652 1/1998 Sultan ..... 60/274
5,732,552 3/1998 Matsumoto et al. ..... 60/276
5,740,676 4/1998 Agustin et al. ..... 60/276

*Primary Examiner*—Thomas N. Moulis
*Attorney, Agent, or Firm*—Mark P. Calcaterra

[57] ABSTRACT

A method and corresponding system for optimizing performance of an internal combustion engine. The present invention senses gases emitted from engine combustion chambers via a first gas sensor and senses gases emitted from said engine combustion chambers subsequent to said gases passing through an engine catalytic converter via a second gas sensor. The temperatures of said first and second gas sensors are then sensed through data output from first and second gas sensors and temperature sensors. The first and second gas sensors are linearized in response to the sensed temperatures of the first and second gas sensors. The fuel level input into the engine combustion chambers is adjusted in response to linearizing of the first and second gas sensors.

19 Claims, 4 Drawing Sheets

OXYGEN SENSOR LINEARIZATION SYSTEM AND METHOD

BACKGROUND AND SUMMARY OF THE INVENTION

The present invention relates generally to a vehicle engine, and more particularly, to an improved sensor feedback control scheme for engines having port fuel injectors that is designed to achieve a more consistent combustion process within the chambers of such engines.

It is critical that the proper, or stoichiometric, air-to-fuel ratio in the combustion chambers of an engine is consistently achieved for efficient and smooth motor vehicle operation. Such a ratio also ensures complete combustion and thereby reduces unwanted combustion byproducts in the exhaust gases. The unwanted compounds of primary importance as found in exhaust gases are hydrocarbons (from the reaction or unburned fuel) and oxides of nitrogen, or "NOx". These compounds, when emitted from motor vehicles, are subject to intense regulatory scrutiny and must be minimized. To help achieve the proper air-to-fuel ratio and thereby reduce the emission of regulated substances, current engine technology uses an oxygen, or "O2", sensor. The sensor is also known as a "lambda" sensor where lambda is the ratio used to define how far the actual air-to-fuel mixture deviates from that theoretically required for complete combustion, and is expressed mathematically as:

$$\lambda = \frac{\text{Air Supplied}}{\text{Theoretical Air Requirement}}$$

The lambda sensor resides in the engine exhaust gas stream and detects oxygen present in the gas stream subsequent to the combustion process. The sensor is designed and calibrated to respond to differing levels of oxygen generated during combustion. Using such a sensor, it can be determined whether the air-to-fuel mixture is "rich" (not enough air for the amount of fuel; $\lambda<1.0$) or "lean" (excess air for the amount of fuel; $\lambda>1.0$).

During operation of a vehicle, the lambda sensor outputs a voltage based on its calibration and the level of oxygen detected. The simplest use of the sensor in the art is as an on/off switch. That is, if the output is above some predetermined target voltage, the air-to-fuel mixture is rich and if it is below the target voltage, the mixture is lean. More sophisticated uses process the actual sensor output through some form of closed loop feedback control system. This type of system compares sensor output to a target value, generates an error, and then develops a correction factor for upcoming combustion cycles. Both applications use lambda sensor output to adjust the amount of fuel used for subsequent combustion cycles, thereby attempting to achieve a stoichiometric air-to-fuel ratio. The conventional way to adjust the amount of fuel is by lengthening or shortening the time pulse of the fuel injectors.

A major drawback of the prior art is that the lambda sensor is very sensitive and its output change is very rapid at the stoichiometric point ($\lambda=1.0$), hence its ease of use as an on/off, or rich/lean, type switch. However, this type of extremely rapid sensor response does not facilitate efficient closed loop control for the air-to-fuel mixtures. As a result, the air-to-fuel ratio fluctuates around stoichiometry, cycling frequently from rich to lean and back again, or from extremely rich or extremely lean to the stoichiometric point and back again.

The present invention disregards this on/off paradigm and, rather, continually uses the entire range of the sensor's output. The process that realizes this continuum of information is called "linearization." With linearization, the sensor becomes a much more integral part of a control process such that its output is used to not only indicate the traditional rich/lean status, but also to be predictive of changing degrees of richness or leanness. Such a system thus has a much tighter operating tolerance to the stoichiometric air-to-fuel ratio than other conventional sensing systems. For a given engine, emissions of hydrocarbons may be favorably reduced by up to 15% and NOx emissions may be reduced by up to 50% without any degradation of engine performance. The present invention operates with a high degree of accuracy even when the oxygen sensors operate under cold transient start-up conditions.

The present invention represents an improvement to the above-described $O_2$ sensing linearization-based system by enabling sensor output data to be utilized over a wider range of operating conditions. In particular, the present invention enables the linearization based system to operate with a high degree of accuracy even when the oxygen sensors operate under cold transient start-up conditions.

Accordingly, a primary object of this invention is to optimize the control system for air-to-fuel ratios of an internal combustion engine.

Another object of the invention is to provide a system and technique for evaluating changing degrees of richness or leanness during the combustion process over a wider range of oxygen sensor operating conditions.

Still another object of the present invention is to reduce regulated substances in automotive exhaust gases.

Another object is to optimize the control system for air-to-fuel ratios for an engine having shorter oxygen sensor feedback and closed loop delay times by better utilizing data from the oxygen sensors under cold transient conditions.

These and other objects will be readily apparent when evaluated with the accompanying drawings and description.

BRIEF DESCRIPTION OF THE DRAWINGS

In the accompanying drawings, wherein reference numbers are consistent throughout the several views.

DETAILED DESCRIPTION OF THE PREFERRED EMBODIMENT

Figure 1:
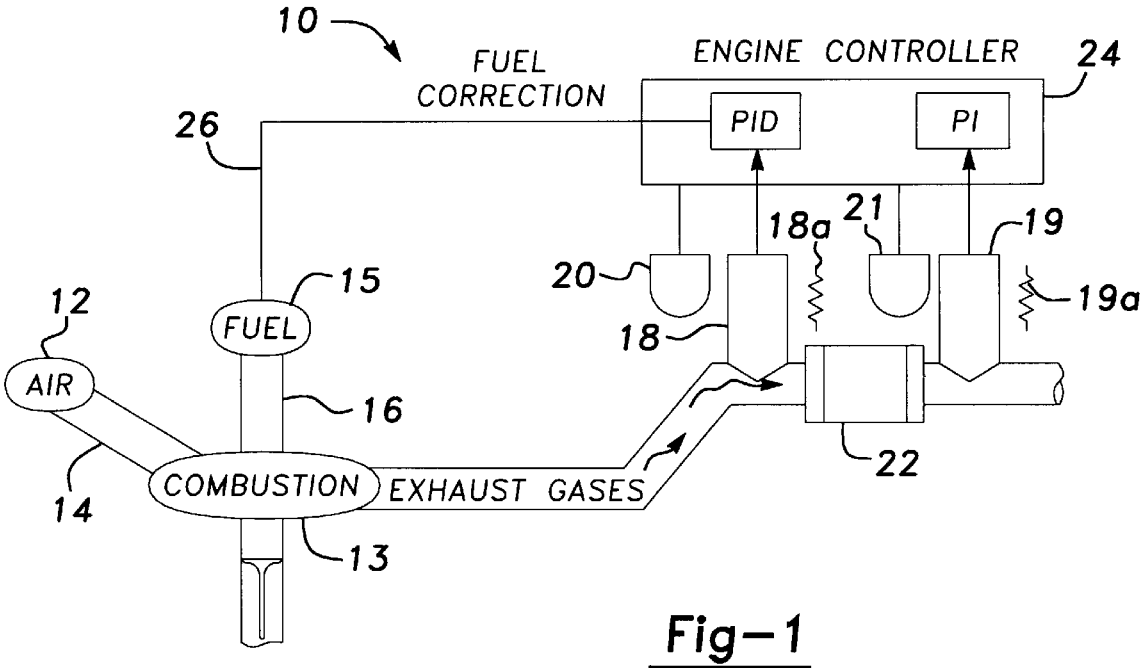
FIG. 1 is a block diagram of relevant engine components and a related emission control apparatus.

Referring to FIG. 1, a typical engine and relevant emission control system components are shown at 10. Air 12 is introduced into a combustion chamber 13 through a manifold 14, and fuel 15 is introduced into the combustion chamber through fuel injectors as shown at 16. The air/fuel mixture is ignited, and the resulting combustion produces exhaust gases that stream out and pass two oxygen, or "lambda", sensors 18, 19, having associated sensor heater elements 18*a,* 19*a* and sensor temperature sensors 20, 21. The upstream sensor 18 evaluates gases out of the combustion chamber 13 and the downstream sensor 19 evaluates gases after catalytic processes have been performed in a catalytic converter 22. The output responses of the sensors 18, 19 are processed through an engine controller 24, which is preferably a PI/PID controller, as described below, and fuel amounts are adjusted accordingly via controller output 26 for subsequent combustion cycles as the process continually repeats itself.

Figure 2:
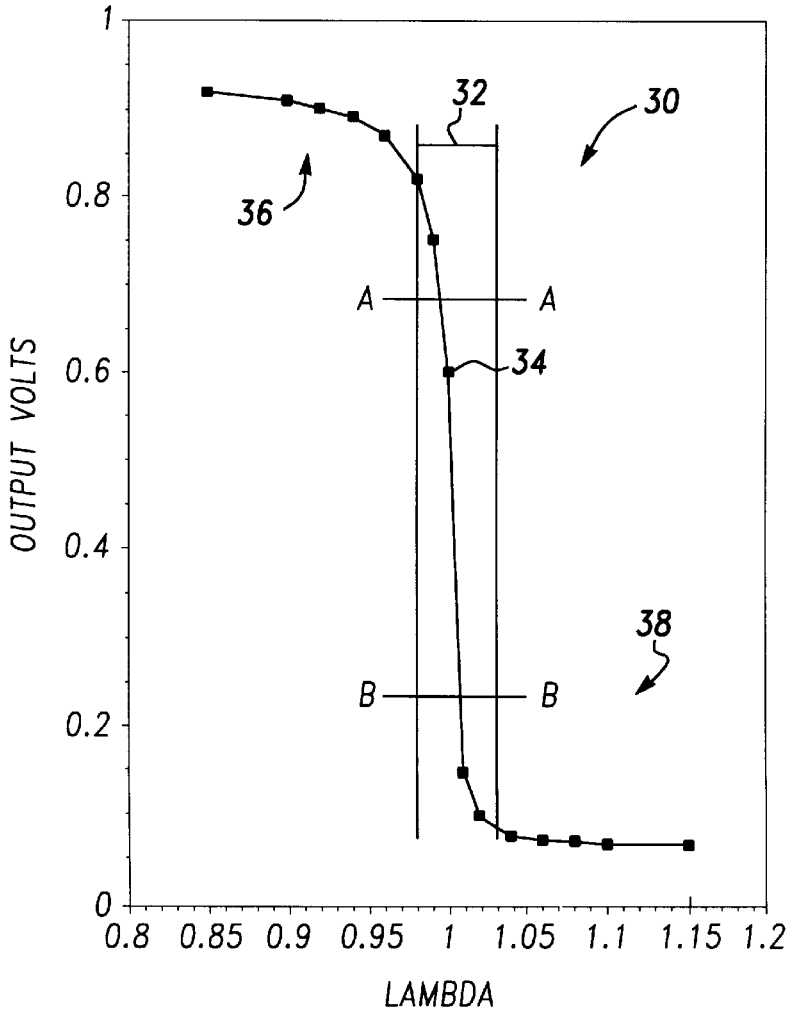
Fig-2 (PRIOR ART)
FIG. 2 is a graph showing a typical output response for a lambda sensor with operating ranges.

In FIG. 2, the typical output response of a lambda sensor is shown at 30. The X-axis represents values of lambda. Lambda is well known in the art as the ratio of actual air supplied to theoretical air required for complete combustion and is used to indicate air-to-fuel stoichiometry during the combustion process. Lambda sensors are calibrated such that when lambda is at a value of 1.0, stoichiometry in the combustion process has been achieved. The Y-axis represents a sensor's typical output response, in volts, for a given lambda. It can be seen that the curve is characterized by one small range of extreme sensitivity 32 around the stoichiometric point 34 where lambda is equal to 1.0, and two very large, unresponsive ranges 36, 38 adjacent the stoichiometric point. The areas 36, 38 adjacent the stoichiometric point represent rich and lean air-to-fuel mixtures, respectively, and are undesired for continuous operation.

As a result of the extremely quick sensor response and corresponding change in sensor output at the stoichiometric point 34, early use of lambda sensors in the prior art did not discern details of lambda output. Rather, as seen in FIG. 2, when the output voltage for the lambda sensor rose above predetermined target voltage A, the mixture was deemed to be rich. In such a case, the engine controller shortened the operation time for a given fuel injector during the next combustion cycle to decrease the amount of fuel going into the combustion chamber in an effort to achieve stoichiometry. Similarly, when lambda output fell below predetermined voltage B, the mixture was deemed lean and the engine controller increased the amount of fuel for upcoming combustion cycles. This pattern of rich and lean oscillation must be minimized for efficient engine operation.

According to the present invention, to better control engine operation, referring to FIG. 1, both lambda sensor output signals are continuously processed through the controller 24. Typically, a proportional—integral, proportional—integral—derivative (PI-PID) control scheme is used to evaluate the two signals and determine corrective actions. Well known in the art, PI-PID control relies on measurements of error from a given target to generate correction factors. It is known that the control scheme is such that the size of the error determines the magnitude of any correction factor and therefore, the rate at which a system returns to operating at its target level. Large errors yield significant correction factors to stabilize out-of-control operation whereas small errors result in only subtle changes. In the case of air-to-fuel mixture control, the target is usually achieved when lambda=1.0, but could be different to accommodate different vehicle operating parameters or conditions.

Figure 2A:
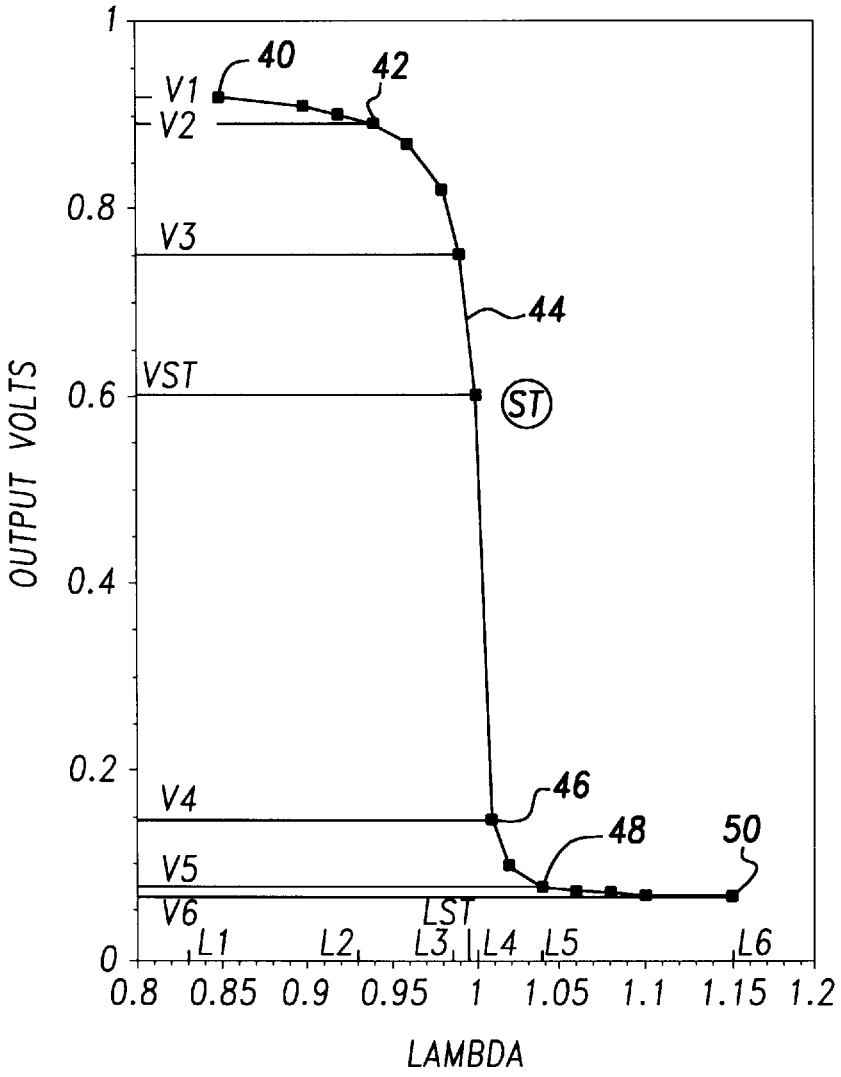
Fig–2A (PRIOR ART)
FIG. 2A is a graph representing how, in the prior art, a typical output response might be used.

Using the same lambda output response, plotted again in FIG. 2A, seven hypothetical positions are shown. Two different rich points are identified at 40 and 42. Two points that reflect a desired operating condition near stoichiometry are 44 and 46. Two lean points are 48 and 50. The stoichiometric target point is identified as ST. The lambdas and resulting output voltages for these positions are identified as L1 and V1, L2 and V2, L3 and V3, L4 and V4, L5 and V5, L6 and V6, and LST and VST, respectively.

As stated earlier, the PI-PID controller 24 used to process the lambda output voltages is most effective with large errors. As such, it can be seen that when V1, V2, V5, V6, and even, but to a lesser extent, V3 and V4 responses, are returned from the lambda sensors 18, 19 and compared to the target VST, large errors are found. The controller 24 uses these errors to make corrections to the amount of fuel going into the combustion chambers 13 for subsequent cycles. The limitation with this scheme, however, can be illustrated by noting that the sensor outputs for rich condition points 40 and 42, V1 and V2, are almost identical. As such, each condition results in similar errors with respect to VST, even though it can be seen that point 42 is clearly more desirable because of its proximity to the stoichiometric point. The result is that both rich conditions receive similar reductions in fuel during the next cycle even though the condition at 40 is much richer and should receive even less fuel. This same analysis can be applied to lean positions 48 and 50 to show that similar fuel increases would be called for by the controller but that point 50 should receive more fuel because it is further away from stoichiometry. Even when the mixture is near stoichiometry such as at point 46, the error that is generated from V4 is almost as great as the errors that result from the extremely lean points 48 and 50.

Thus, it can be seen that because of the quick response of the sensor at or near lambda=1.0, it is very difficult to achieve only a small error with respect to the target LST. Thus, with larger errors, the PI-PID controller 24 generates larger correction factors that are not appropriate for points such as 44 and 46, where lambda is close to 1.0, and over corrections that result in an oscillatory action of the air-to-fuel ratio around the stoichiometric point, but that rarely achieve stoichiometry point.

Figure 3:
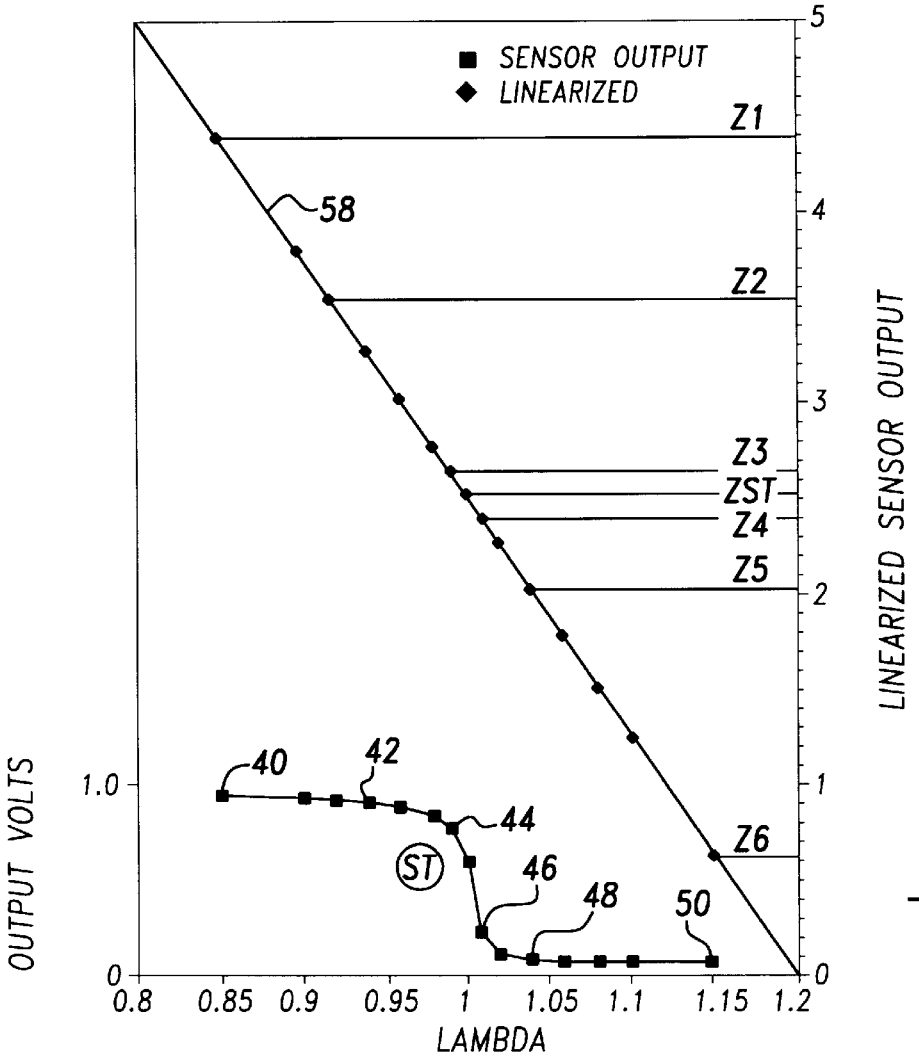
FIG. 3 is a graph representing a typical output for a lambda sensor and its subsequent transformation into a linearized format.

FIG. 3 illustrates the output of the system of an $O_2$ sensor output linearization-based system through a reproduction of the lambda sensor response curve with points 40, 42, 44, 46, 50 and ST identified, but rescaled on the small left Y axis. The diagonal line 58 is used to generate the linearized sensor response for use during closed loop feedback control. To linearize, data points from the original lambda response curve are projected up onto the diagonal line. The right Y axis represents new linearized sensor response values for each of the projected points. The linearized output scale is shown from 0 to 5, but can be scaled to any convenient range of numbers.

Figure 4:
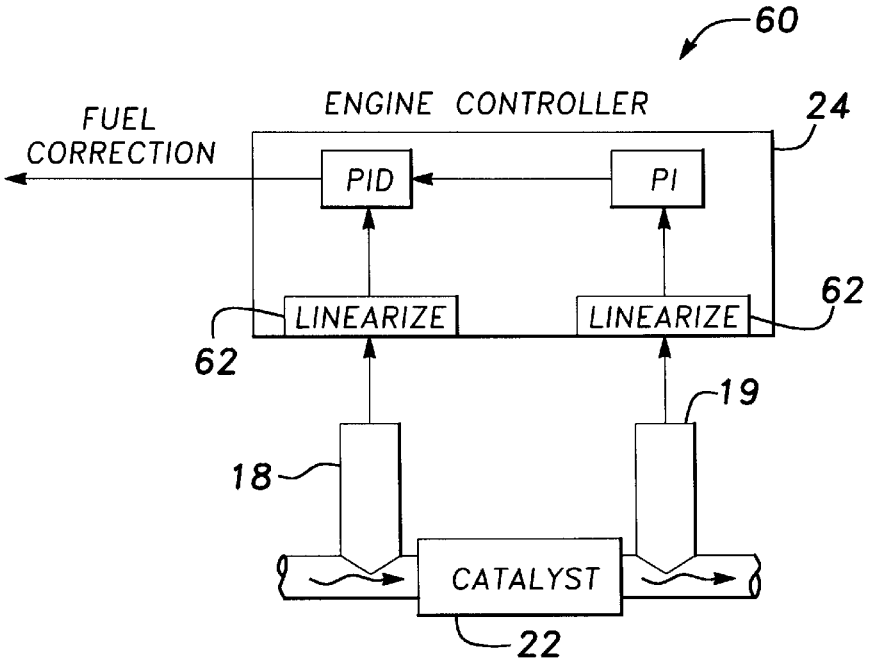
FIG. 4 is fragmented view of FIG. 1, showing the preferred location of the linearization process.

In the block diagram shown at 60 in FIG. 4, it can be seen that the preferred location for linearization of the lambda sensor outputs is prior to the application of the PI-PID control scheme. There, signals from both the upstream and downstream lambda sensors 18, 19 are retrieved. Values for both sensors are conditioned according to linearization tables 62 stored in the engine controller. When done in this way, the linearized Z1 through Z6 outputs shown in FIG. 3 are used to generate errors as opposed to the actual V1 through V6 output voltages of FIG. 2A as detailed earlier. The linearization tables are derived from testing and evaluation of performance criteria for each individual application, including such things as compensation for temperature of the exhaust gas, desired engine performance, and different brands of lambda sensors.

The benefits of the Z responses can be illustrated at the three operating conditions: rich, lean, and stoichiometry. Lambda responses at rich condition points 40 and 42 are linearized to be Z1 and Z2. It can be seen that these two errors with respect to the linearized target, ZST, will be vastly different. That is, the extremely rich condition point 40 with response Z1 will result in a much larger error than the moderately rich condition point 42 and Z2. As a result, the controller 24 will generate a much larger fuel correction for 40 than for 42, moving 40 quickly back toward the target point. Similarly, super lean condition point 50 and its linearized response Z6 will generate a much larger error than moderately lean condition point 48 and Z5. Lastly, points 44 and 46 near stoichiometry have linearized responses Z3 and Z4, both of which are very close to the target response ZST and, as such, generate small errors. At these conditions, the controller will not initiate large corrections and as a result, the engine will operate closer to stoichiometry.

Figure 5:
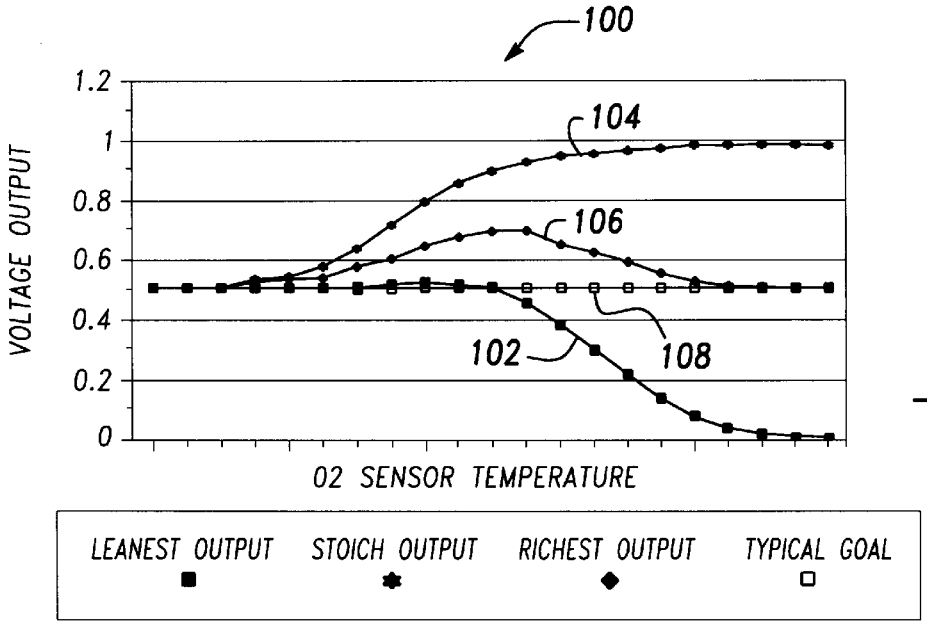
FIG. 5 is a graph representing oxygen sensor output versus oxygen sensor temperature for air-to-fuel mixtures.
Figure 6:
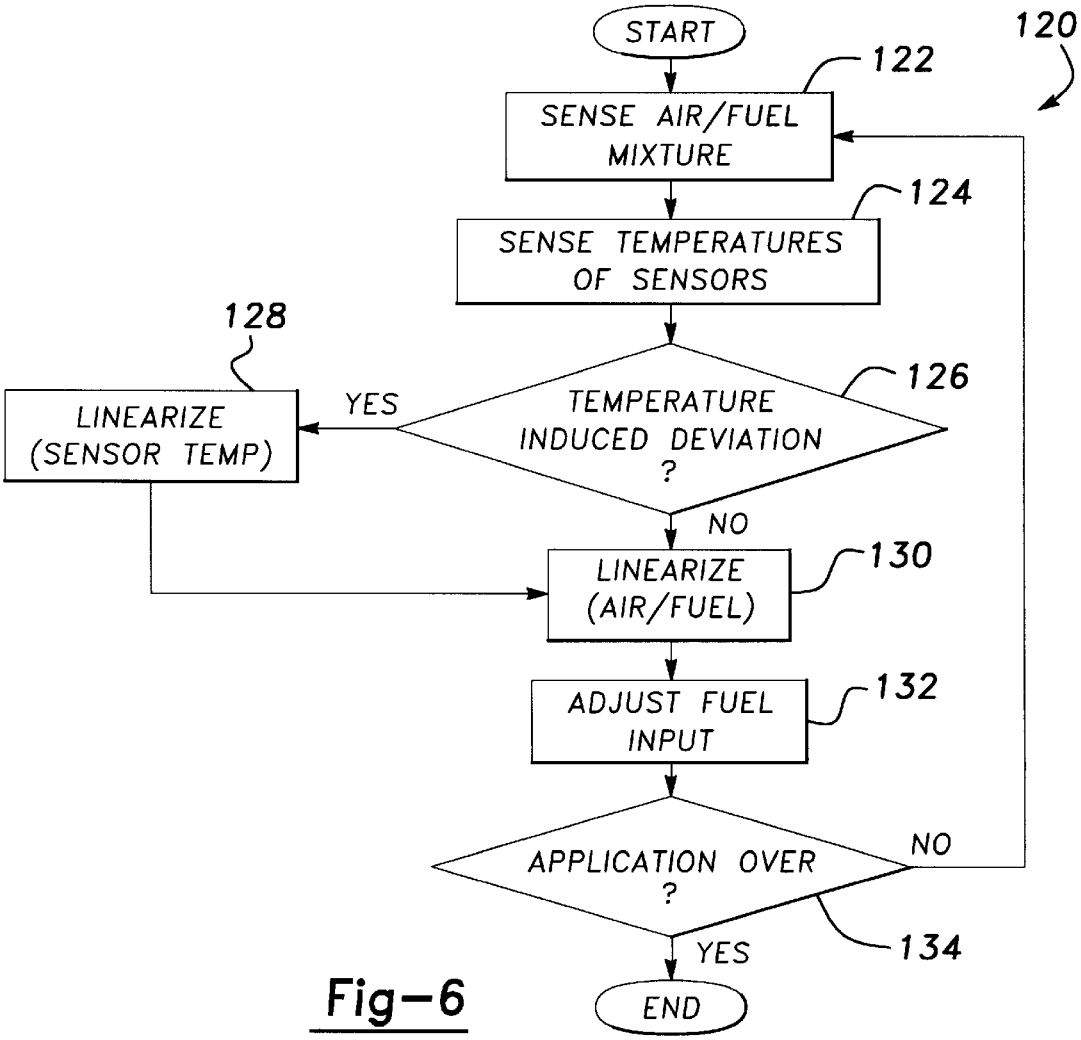
FIG. 6 is a flow diagram illustrating the preferred methodology of the present invention.

Referring to FIGS. 5 and 6, the improvement to the $O_2$ sensor output linearization-based system according to a preferred embodiment of the present invention will now be described. A graph of the voltage output for the sensors 18, 19 versus temperature of the sensors is shown generally at 100. The temperature of sensor 18 is detected by the temperature sensor 20, while the temperature of sensor 19 is detected by the temperature sensor 21. Each of the temperature sensors 20, 21 generate a corresponding $O_2$ sensor temperature signal, which is input into the engine controller 24 for closed loop feedback control of the system of the present invention as described below in more detail.

As shown in FIG. 5, the output of the sensors 18, 19 versus the fuel/air ratio in the exhaust varies with the temperature of the sensors. For example, for a very lean fuel/air output, the sensor output versus temperature has a characteristic curve as shown at 102. Conversely, if the temperature sensors sense a rich fuel/air output, the sensor output characteristic curve is as shown at 104. A stoichiometric fuel/air mixture is shown at 106. However, as can be seen from the curve at 106, which represents approximate stoichiometry measurements, the sensor output is shifted higher than the ideal output stoichiometry, which is shown at 108. This upward shift is characteristic of the sensor during sensor warm-up and causes the $O_2$ sensor feedback system to react as if the system senses a fuel rich output. The amount of fuel being supplied to the engine is as a result unnecessarily reduced. This unnecessary reduction in fuel consequently causes reduction in engine performance and emissions related problems, such as hesitations, sags, stumbles and die-outs.

The temperature sensors can be realized by a thermocouple or temperature sensor for direct measurement of sensor temperatures. Alternatively, temperature sensors may be designed to measure the resistance of the sensor heater elements 18*a,* 19*a* to determine sensor temperature where the temperature sensor heater element is a PTC (positive temperature coefficient) type having a resistance that varies directly with temperature. The temperature sensors could also be sensors used to input data into the engine controller 24 that models sensor temperature using known ambient, air flow and engine operating condition parameters.

FIG. 6 shows a flow diagram illustrated generally at 120 showing the methodology of the oxygen sensor linearization system of the present invention. At step 122, the first and second sensors 18, 19 sense the air/fuel mixture in the exhaust from the engine combustion chamber 13 and from the catalytic convertor 22 as described above. At step 124, the temperature sensors 20, 21 sense the temperature of the sensors 18, 19, respectively, and generate a voltage signal which is sent to the controller 24. At step 126, the controller processes the information from both the sensors and the temperature sensors and determines, based on the temperature signals from the temperature sensors, whether there is a deviation in the output signals from the sensors caused by sensor warmup. If such a temperature deviation exists, the methodology proceeds to step 128 and the sensor voltage outputs versus sensor temperature readings are linearized to eliminate deviation due to sensor warmup. The methodology then returns to step 130 where the signals generated by the sensors are also linearized as shown in the graph in FIG. 3. At step 1 32, the fuel input to the engine is adjusted based on the linearized information processed by the controller to thereby ensure that the engine is operating at an ideal air/fuel mixture. At step 134, the methodology determines if the application is over. If not, the methodology returns to step 122. If the engine is subsequently turned off, the application and methodology end.

Upon reading of the foregoing description, it should be appreciated that the present invention linearizes the sensor outputs to reduce the effect of sensor warmup on sensor output signals. As a result, engine performance and emissions controls problems associated with sensor warmup are reduced. The present invention thereby allows data from the sensors 18, 19 to be utilized by the system even during sensor warmup.

It is understood that the discussion of the embodiments above, when evaluated in conjunction with the drawings and specifications, will suggest further embodiments which should be evaluated in the context of the following claims.

What is claimed is:

1. A method for optimizing performance of an internal combustion engine, comprising:

sensing gases emitted from engine combustion chambers via a first gas sensor;

sensing gases emitted from said engine combustion chambers subsequent to said gases passing through an engine catalytic converter via a second gas sensor;

sensing temperatures of said first and second gas sensors via temperature sensors;

processing signals output from said first and second gas sensors and said temperature sensors to determine if the signals output from the first and second gas sensors include deviations caused by sensor warmup;

linearizing said first and second gas sensors in response to said step of sensing temperatures of said first and second gas sensors if the signals output from the first and second gas sensors include deviations caused by sensor warmup; and adjusting fuel level input into said engine combustion chambers in response to said step of linearizing said first and second gas sensors.

2. The method of claim 1, wherein step of processing signals comprises processing data via a PI-PID controlling scheme.

3. The method of claim 1, wherein said step of sensing gases via a first gas sensor and said step of sensing gases via a second gas sensor comprise the step of sensing gases via first and second lambda sensors.

4. The method of claim 1, wherein said step of sensing gases via a first gas sensor and said step of sensing gases via a second gas sensor comprise steps of sensing gases via said first and second sensors and outputting signals representing deviation of said internal combustion engine from stoichiometry.

5. The method of claim 1, wherein said step of sensing temperatures of said first and second sensors comprises measuring temperatures of said first and second sensors directly via a thermocouple.

6. The method of claim 1, wherein said step of sensing temperatures of said first and second sensors comprises the step of measuring resistance of heater elements associated with said first and second temperature sensors.

7. The method of claim 1, further comprising the step of modeling temperatures of said first and second gas sensors using known ambient, air flow and engine operating conditions after said step of sensing temperatures of said first and second gas sensors.

8. A system of optimizing performance of an internal combustion engine including a plurality of combustion chambers and a catalytic convertor, comprising:

a first gas sensor located in an exhaust stream of said plurality of combustion chambers for generating a signal corresponding to an exhaust stream fuel/air mixture;

a second sensor located in an exhaust stream of said catalytic convertor for generating a signal corresponding to an exhaust stream fuel/air mixture;

temperature sensing means for sensing temperature of said first and second sensors;

a controller for processing said signals generated by said first and second sensors to control fuel being input into said plurality of engine combustion chambers, said controller adjusting linearization of said first and second sensors in response to sensed sensor temperatures to increase accuracy of said signals generated by said first and second sensors through a closed loop feedback system, to thereby achieve stoichiometry.

9. The system of claim 8, wherein said controller comprises a PI-PID controller.

10. The system of claim 8, wherein said sensors comprises lambda sensors.

11. The system of claim 8, wherein said controller adjusts signals generated by said first and second sensors to minimize temperature effects on said sensors.

12. The system of claim 8, wherein said controller includes a memory for storing linearization tables derived from testing and evaluation of performance criteria for a given range for engine conditions.

13. The system of claim 8, wherein said controller controls fuel input into said plurality of combustion chambers by adjusting fuel injector pulsing.

14. The system of claim 8, wherein said signals generated by said first and second sensors are indicative of deviation of said engine fuel/air ratio from stoichiometry.

15. The system of claim 8, wherein said controller controls said engine fuel/air ratio through a closed loop feedback control system.

16. The system of claim 8, wherein said temperature sensing means comprises a thermocouple.

17. The system of claim 8, further comprising a first sensor heater element for heating said first sensor and a second sensor heater element for heating said second sensor, said controller being operative to measure resistance of said first and second sensor heater elements to determine first and second sensor temperatures.

18. The system of claim 8, wherein said temperature sensing means comprises modeling means for modeling temperatures of said first and second sensors using known ambient, air flow and engine operating conditions.

19. In an internal combustion engine system including an internal combustion engine having a plurality of combustion chambers and a catalytic converter, said system also including a first gas sensor located in an exhaust stream of said plurality of combustion chambers that generates a signal corresponding to a first exhaust stream fuel/air mixture, a second gas sensor located in an exhaust stream of said catalytic converter that generates a signal corresponding to a second exhaust stream fuel/air mixture, and a gas sensor controller that processes said signals generated by said first and second sensors for combustion chamber fuel input control, a system for optimizing performance of said internal combustion engine comprising:

a plurality of temperature sensors that generate a signal in response to sensor temperatures of said first and second gas sensors; and a temperature sensor controller that linearizes said first and second gas sensors in response to temperatures sensed by said plurality of temperature sensors to increase accuracy of said signals generated by said first and second gas sensors.

* * * * *